US005764251A

United States Patent [19]

Hashimoto

[11] Patent Number: 5,764,251

[45] Date of Patent: Jun. 9, 1998

[54] RECORDING MEDIUM DISCRIMINATING DEVICE, INK JET RECORDING APPARATUS EQUIPPED THEREWITH, AND INFORMATION SYSTEM

[75] Inventor: Reiji Hashimoto, Yokohama, Japan

[73] Assignee: Canon Kabushiki Kaisha, Tokyo, Japan

[21] Appl. No.: 457,784

[22] Filed: Jun. 1, 1995

[30] Foreign Application Priority Data

Jun. 3, 1994 [JP] Japan ..... 6-122824

[51] Int. Cl.[6] ..... B41J 29/38

[52] U.S. Cl. ..... 347/16; 347/19; 250/559.16; 250/559.18; 356/446

[58] Field of Search ..... 347/16, 104, 19; 399/389; 250/559.11, 559.12, 559.15, 559.16, 559.18; 356/446

[56] References Cited

U.S. PATENT DOCUMENTS

| | | | |
|---|---|---|---|
| 1,917,379 | 8/1933 | Lowery . | |
| 4,983,854 | 1/1991 | Mizuno et al. . | |
| 5,004,928 | 4/1991 | Suzuki et al. | 347/104 |
| 5,139,339 | 8/1992 | Courtney et al. | 356/446 |
| 5,488,456 | 1/1996 | Jamzadeh | 399/389 |

FOREIGN PATENT DOCUMENTS

| | | | |
|---|---|---|---|
| 556045 | 8/1993 | European Pat. Off. | 347/104 |

*Primary Examiner*—John E. Barlow, Jr.

*Attorney, Agent, or Firm*—Fitzpatrick, Cella, Harper & Scinto

[57] ABSTRACT

A recording medium discriminating device includes a device for measuring a multi-directional reflection function on a surface of a recording medium and a device for judging the kind of the recording medium based on the results derived from the measurement.

37 Claims, 8 Drawing Sheets

RECORDING MEDIUM DISCRIMINATING DEVICE, INK JET RECORDING APPARATUS EQUIPPED THEREWITH, AND INFORMATION SYSTEM

BACKGROUND OF THE INVENTION

1. Field of the Invention

The present invention relates to a recording medium discriminating device for discriminating the kind of recording medium. In addition, the present invention relates to an information processing system such as a copying machine, a facsimile, a printer, a word processor, a personal computer and so forth having the foregoing recording apparatus used as outputting means. Here, the word "recording" represents the state that ink is applied to all ink receiving articles such as cloth, thread, paper, sheet-shaped material and so forth each adapted to receive ink herein. Thus, the present invention can be applied not only to an information processing field but also to wide industrial fields inclusive of an apparel industry adapted to use an ink receiving article for receiving ink thereon.

2. Description of the Related Art

Since an ink jet recording system has advantages as high accuracy image outputting means and high speed recording means many requests have been from wide industrial fields (including the apparel industry and so forth) for providing an ink jet recording system capable of providing a higher quality of image.

To assure that an image is recorded with a high quality, it is necessary that recording control is executed corresponding to the kind of recording medium. Namely, when recording mediums each having a large difference in respect of ink permeable force and ink drying speed, e.g., a paper and a transparency film are used by the conventional ink jet recording apparatus, it is necessary to change a conveying method for each of these recording mediums. Therefore, if the conventional ink jet recording apparatus can not exactly discriminate the kind of a recording medium to be used, the result is that a quality of recorded image is remarkably degraded, and moreover, the interior of the ink jet recording apparatus is contaminated with foreign material. To cope with this malfunction, a device for determining the kind of a recording medium (recording medium discriminating device) has been developed.

FIG. 1 is a schematic perspective view which shows the structure of an ink jet recording apparatus equipped with a recording medium discriminating device. This recording medium discriminating device is constructed such that a difference of reflection coefficient as measured on the surface of the recording medium is optically measured by a reflection type photosensor from a fixed angle so as to enable the kind of the recording medium to be determined in accordance with a threshold method.

In the drawing, reference numeral 1 denotes carriage having a ink jet head (not shown) mounted thereon, reference numeral 2 denotes a main scanning belt for reciprocably displacing the carriage 1, reference numerals 3 and 4 denote pulleys for displaceably holding the scanning belt 2, reference numeral 5 denotes a main scanning motor for rotating the pulley 3, reference numeral 6 denotes a recording medium, reference numerals 7 and 8 denote rollers for holding and conveying the recording medium 6, reference numeral 9 denotes a platen, reference numeral 10 denotes a reflection mirror disposed in the platen, and reference numeral 11 denotes a reflection type photosensor which is mounted on the carriage 1 to move together with the latter.

FIG. 2 is a schematic view which explains the structure of a conventional recording medium discriminating device and a measuring principle of the conventional recording medium discriminating device. In the drawing, reference numeral 12 denotes a light emitting element, and reference numeral 13 designates a light receiving element. The light emitting element 12 and the light receiving element 13 include a light collecting optical system of which focus distance and angle are adjusted so as to allow a focus to be situated on an identical location on the recording medium, respectively. To assure that a difference in surface reflection coefficient of the recording medium is easily reflected in an output from the light receiving element 13, the light receiving element 13 is mounted with a certain offset from a normal reflection angle. In addition, to provide a reference value for discrimination, the platen 9 is coated with non-reflection coating material, and an angle of the reflection mirror 10 is set such that the light beam from the light emitting element 12 is normally reflected at the reflection mirror 10, and thereafter, it impinges on the light receiving elements 13.

FIG. 3 is a diagram which schematically shows how an output from the light emitting element 12 varies from recording medium to recording medium. Line (a) shows the case that no recording paper is present, line (b) shows the case that a plain paper is used as a recording medium, and FIG. (c) shows the case that a transparency film is used as a recording medium In the drawing an abscissa represents the position of the carriages, and an ordinate represents an output of the light receiving element 13.

Line (a) shows that when the photosensor is located above the reflection mirror, a maximum output value is obtained but it exhibits that a minimum output value is obtained when the photosensor is located at the position other than the reflection mirror. A threshold value to be used as a reference for discriminating the kind of recording medium is determined from these values.

Line (b) shows that an output value from the light receiving element is within the range of the threshold value for plain paper. Since the output does not vary at the position of normal reflection of the reflection mirror, it is discriminated that the recording medium is a plain paper.

Line (c) shows that an output from the light receiving element is within the range defined by a threshold value of the transparency film. Since the output is increased at the position of normal reflection of the reflection mirror, it is discriminated that the recording medium is a transparency film.

When a colored image is recorded by the ink jet system, there sometimes occurs an occasion that coefficient associated with image processing should be changed corresponding to color exhibition. The foregoing conventional recording medium discriminating device is intended to discriminate the paper from the transparency film, and this is possible because surface reflection coefficient and permeability of both the materials are remarkably different from each other. However, in the case that color exhibition of the recording medium is handled, it is required that discrimination is made based on a very small difference, e.g., between a coated paper and a plain paper. In the case that recording is effected with the coated paper, when the rear surface of the recording paper is erroneously recorded not only during color recording but also during monochromatic recording, the quality of recorded image is largely degraded, and moreover, the interior of the apparatus is contaminated with foreign material. In the case of simple reflection coefficient and threshold value like the conventional recording medium discriminating device, it is difficult to stably discriminate the recording medium not only during color recording but also during monochromatic recording.

SUMMARY OF THE INVENTION

The present invention has been made in consideration of the aforementioned background.

Therefore, an object of the present invention is to provide a precise recording medium discriminating device and method for discriminating the kind of a recording medium in order to make it possible to provide an ink jet recording apparatus having excellent manerverability while assuring a high quality of image formed by a recording operation optimum to properties of a recording medium, and moreover, preventing the rear surface of the recording medium from being erroneously recorded.

In a first aspect of the present invention, there is provided a recording medium discriminating device, comprising;

means for measuring a multi-directional reflection coefficient function on the surface of a recording medium, and means for judging the kind of the recording medium based on the results derived from the measurement.

The recording medium may be a recording medium which is usable for recording image informations with the aid of an ink jet recording apparatus.

The measuring means may include at least one light emitting member and at least one photoelectric transducer member.

At least one of the light emitting member and the photoelectric transducer member may include a light collecting optical system of which focus is situated on the recording medium.

A recording medium discriminating device may further include means for allowing at least one vector among a light source vector between the light emitting means and the focus and a visual line vector between the photoelectric transducer and the focus to be changed.

each of the light emitting means and the photoelectric transducer member may be constructed of a semiconductor clement.

In a second aspect of the present invention, there is provided a recording medium discriminating device, comprising means for measuring a multi-reflection coefficient function on the surface of a recording medium with reference to a plurality of spectral sensitivity properties, and means for judging the kind of the recording medium based on the results derived from the measurement.

The recording medium may be a recording medium usable for recording image informations with the aid of an ink jet recording apparatus.

The measuring means may include at least one light emitting means and at least one photoelectric transducer.

At least one of the light emitting means and the photoelectric transducer may include a light collecting optical system of which focus is located on the surface of the recording medium.

The recording medium discriminating device may further include means for allowing at least one vector among a light source vector between the light emitting means and the focus and a visual line vector between the photoelectric transducer and the focus to be changed.

Each of the light emitting means and the photoelectric transducer may be constructed of a semiconductor element.

In a third aspect of the present invention, there is provided an ink jet recording apparatus including a carriage having recording means adapted to output image information by ejecting ink droplets to a recording medium mounted thereon, the carriage serving to displace the recording means in the main scanning direction, and conveying means for conveying the recording medium in the auxiliary scanning direction, characterized in that the ink jet recording apparatus is equipped with a recording medium discriminating device including means for measuring a multi-directional reflection coefficient function on that surface of the recording medium, and means for judging the kind of the recording medium based on the results derived from the measurement.

The measuring means may include at least one light emitting member and at least one photoelectric transducer, and at least one of the light emitting member and the photoelectric transducer includes a light collecting optical system of which focus is situated on the recording medium.

The ink jet recording apparatus may further include means for allowing at least one vector among a light source vector between the light emitting means and the focus and a visual line vector between the photoelectric transducer and the focus to be changed.

Each of the light emitting means and the photoelectric transducer may be constructed of a semiconductor element.

The ink jet recording apparatus may further include means for controlling a recording operation to be performed based on data outputted from the recording medium discriminating device, and moreover, controlling conveyance of the recording medium with the aid of the conveying means.

The recording medium discriminating device may be displaced in the main scanning direction as the recording means is displaced.

The recording means may include a thermoelectric transducer for allowing a phenomenon of film boiling to appear in ink, the thermoelectric transducer serving to generate energy for ejecting ink droplets therefrom.

In a fourth aspect of the present invention, there is provided an ink jet recording apparatus including a carriage adapted to output image informations by ejecting ink droplets to a recording medium mounted thereon, the carriage serving to displace the recording medium in the main scanning direction, and conveying the recording medium in the auxiliary direction, characterized in that the ink jet recording apparatus is equipped with a recording medium discriminating device including means for measuring a multi-directional reflection coefficient function on the surface of the recording medium with reference to a plurality of spectral sensitivity properties, and means for judging the kind of the recording medium based on the results derived from the measurement.

The measuring means may include at least one light emitting member and at least one photoelectric transducer, and preferably, at least one of the light emitting member and the photoelectric transducer includes a light collecting optical system of which focus is situated on the recording medium.

The ink jet recording apparatus may further include means for allowing at least one vector among an optical source vector between the light emitting means and the focus and a visual vector between the photoelectric transducer and the focus to be changed.

Each of the light emitting means and the photoelectric transducer may be constructed of a semiconductor element.

The ink jet recording apparatus may further include means for controlling a recording operation of the recording means with reference to data to be outputted from the recording medium discriminating device, and means for controlling conveyance of the recording medium by the conveying means.

The recording medium discriminating device may be displaced in the main scanning direction as the recording means is displaced.

The recording means may include a thermoelectric transducer for allowing a phenomenon of film boiling to appear in ink as energy generating means for ejecting ink droplets.

In a fifth aspect of the present invention, there is provided an information processing system, characterized in that in a recording device having an ink jet recording apparatus as outputting means, the ink jet recording apparatus has the recording means for outputting image information by ejecting ink droplets toward a recording medium mounted thereon, and includes a carriage for displacing the recording means in the main scanning direction and conveying means for conveying the recording medium in the transverse direction, and moreover, the information processing system is equipped with a recording medium discriminating device including means for measuring a multi-directional reflection coefficient function on the surface of the recording medium with reference to a plurality of spectral sensitivity properties and means for judging the kind of the recording medium with reference to the results derived from the measurement.

In a sixth aspect of the present invention, there is provided a recorded article including an image outputted from an ink jet recording apparatus, characterized in that the ink jet recording apparatus has recording means for outputting image information by ejecting ink droplets toward a recording medium mounted thereon, and includes a carriage for displacing the recording means in the main scanning direction and conveying means for conveying the recording medium in the auxiliary direction, and moreover, there is provided a recording medium discriminating device including means for measuring a multi-directional reflection coefficient function on the surface of the recording medium with reference to a plurality of spectral sensitivity and means for judging the kind of the recording medium based on the results derived from the measurement.

In a seventh aspect of the present invention, there is provided a recording medium discriminating method, comprising;

a measuring step of measuring a multi-directional reflection coefficient function on the surface of a recording medium, and a judging step of judging the kind of the recording medium based on the results derived from the measurement.

The recording medium may be a recording medium usable for recording image information outputted from an ink jet recording apparatus.

The measuring step may be practiced by using measuring means including at least one light emitting member and at least one photoelectric transducer.

At least one of the light emitting member and the photoelectric transducer may include at least one light collecting optical system of which focus is situated on the recording medium.

A recording discriminating method may further include a step of allowing at least one vector among a light source vector between the light emitting means and the focus and a visual line vector between the photoelectric transducer and the focus to be changed.

In an eighth aspect of the present invention, there is provided a recording medium discriminating method, comprising; a measuring step of measuring a multi-directional reflection coefficient function on the surface of a recording medium with reference to a plurality of spectral sensitivity properties, and a discriminating step of judging the kind of the recording medium based on the results derived from the measurement.

The recording medium may be a recording medium usable for recording image informations outputted from an ink jet recording apparatus.

The measuring step may be practiced by using measuring means including at least one light emitting member and at least one photoelectric transducer.

At least one of the light emitting member and the photoelectric transducer may include at least a light collecting system of which focus is located on the recording medium.

The recording medium discriminating method may further include a step of allowing at least one vector among a light source vector between the light emitting means and the focus and a visual line vector between the photoelectric transducer and the focus to be changed.

The above and other objects, effects features and advantages of the present invention will become more apparent from the following description of embodiments thereof taken in conjunction with the accompanying drawings.

DESCRIPTION OF THE PREFERRED EMBODIMENTS

The present invention will now be described in detail hereinafter with reference to the accompanying drawings which illustrate preferred embodiments thereof.

<First Embodiment>

An ink jet recording apparatus includes a carriage having recording means (recording head) and an ink tank mounted thereon, conveying means for conveying a recording medium (e.g., recording paper), and controlling the foregoing components. The recording head for ejecting ink droplets from a plurality of ejecting ports is serially scanned in the direction (main scanning direction) at a right angle relative to the conveying direction (auxiliary scanning direction) of the recording medium. On the other hand, while no recording operation is performed, the recording medium is intermittently conveyed by a quantity equal to a recording width.

Figure 1:
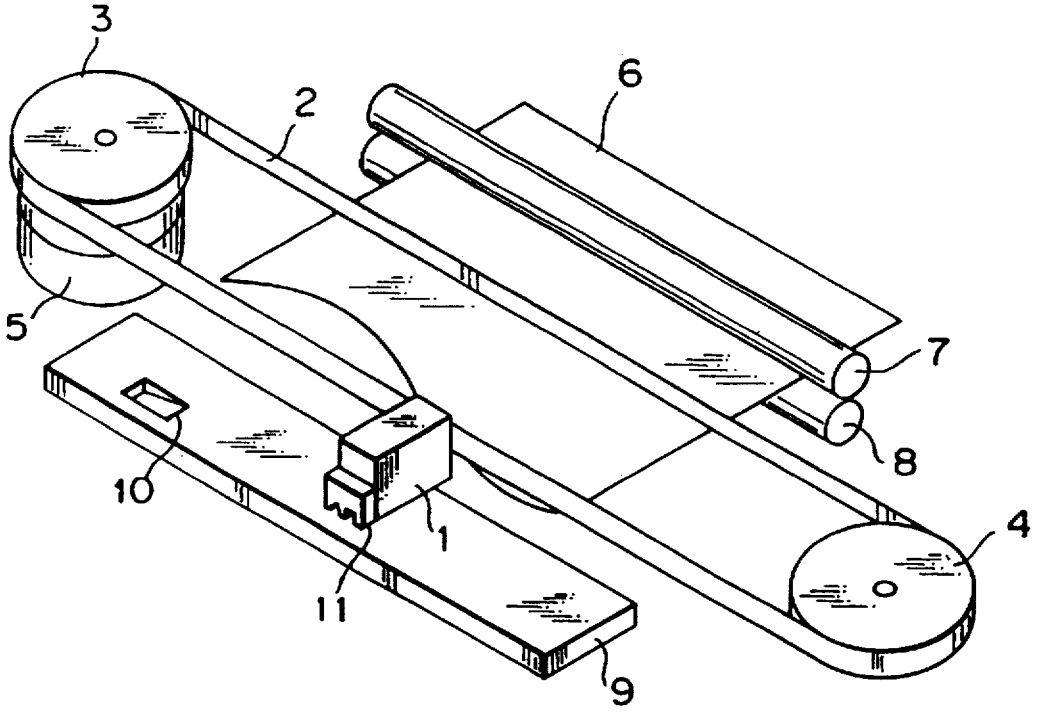
FIG. 1 is a perspective view which schematically shows the structure of an ink jet recording apparatus.
Figure 2:
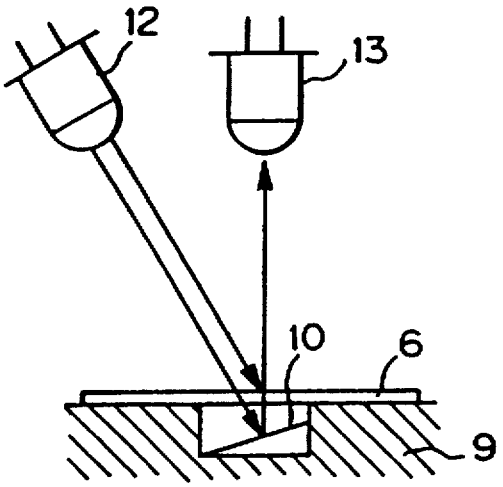
FIG.2 PRIOR ART
FIG. 2 is a schematic view which explains the structure of a recording medium discriminating device known as associated art and operation of the recording medium discriminating device.
Figure 3:
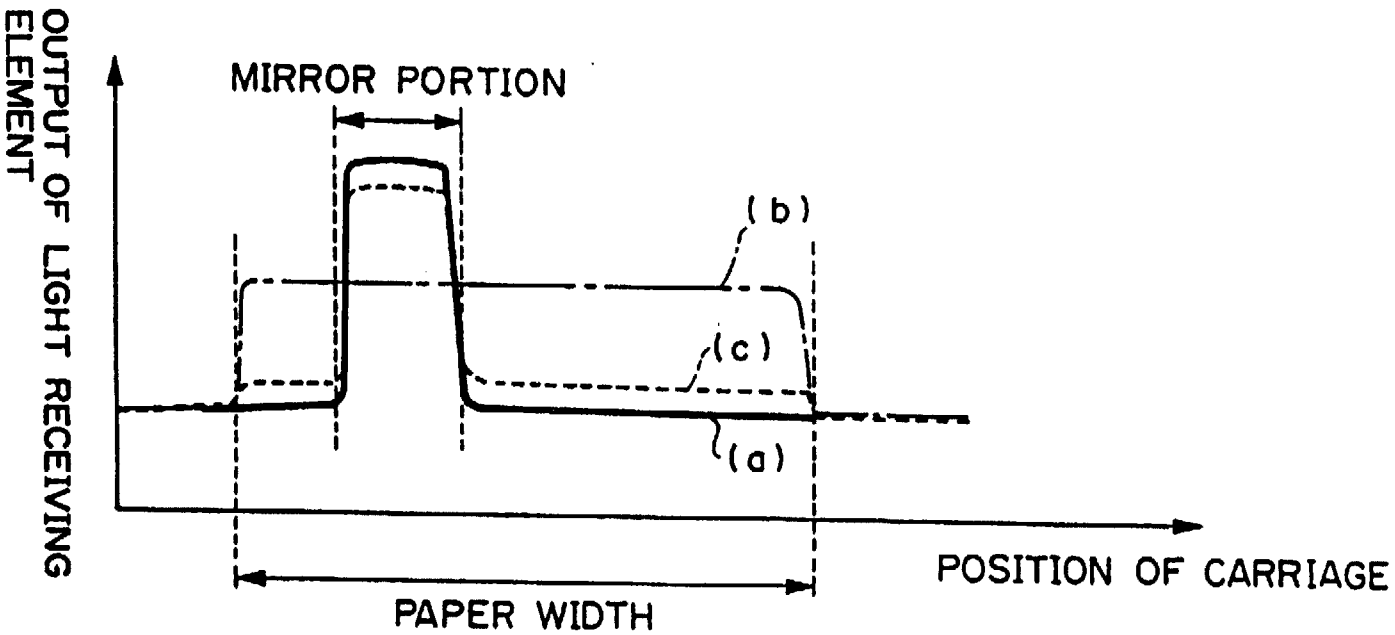
FIG. 3 PRIOR ART
FIG. 3 is a graph which explains measurement conducted by the recording medium discriminating device shown in FIG. 2.
Figure 4:
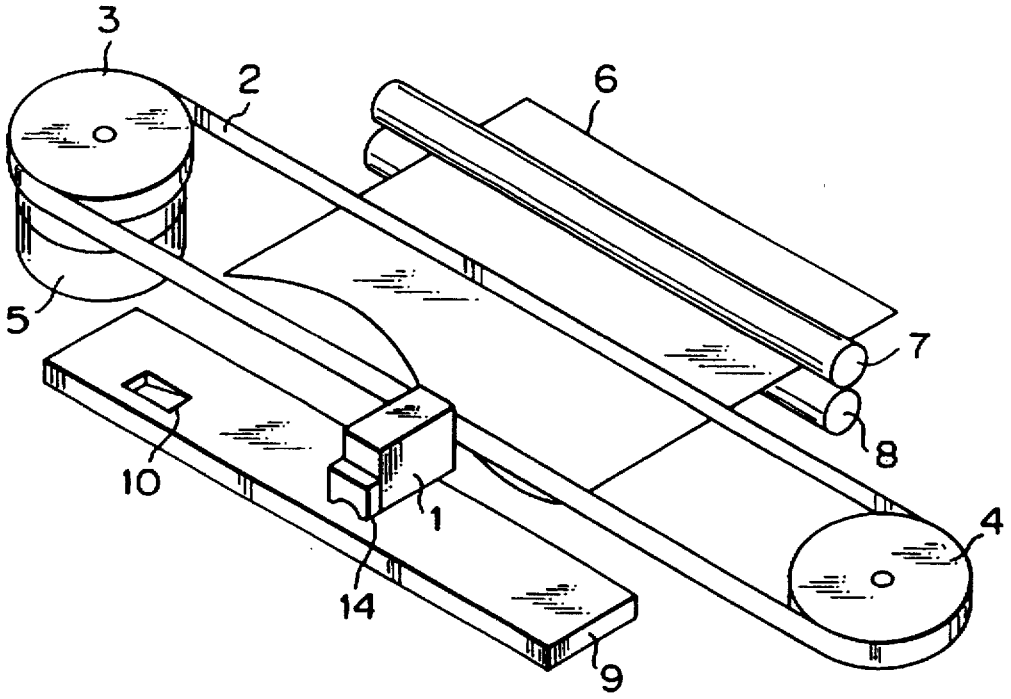
FIG. 4 is a perspective view which schematically explains the structure of a recording medium discriminating device constructed according to the present invention and operation of the recording medium discriminating device.

FIG. 4 is a perspective view which schematically shows the structure of the ink jet recording apparatus constructed in accordance with this embodiment. In the drawing, reference numeral 1 denotes a carriage having an ink jet recording head (not shown) including a thermoelectric transducer for allowing a phenomenon of film boiling to appear in ink as energy generating means mounted thereon, reference numeral 2 denotes main scanning belt for reciprocably displacing the carriage 1, reference numerals 3 and 4 denote pulleys for holding and recirculating the main scanning belt 2, reference numeral 5 denotes a main scanning motor for rotating the pulleys 3 and 4, reference numeral 6 denotes a recording medium, reference numerals 7 and 8 denote rollers for holding and conveying the recording medium 6, and reference numeral 9 denotes a platen.

Reference numeral 14 denotes a recording medium discriminating device mounted on the carriage 1. The recording medium discriminating device 14 is substantially constructed by a reflection type photosensor. With this ink jet recording apparatus, the surface of the platen 9 is coated with non-reflection coating material, and a cavity is formed on the platen 9. In addition, a reflective mirror 10 is disposed in the cavity.

Figure 5:
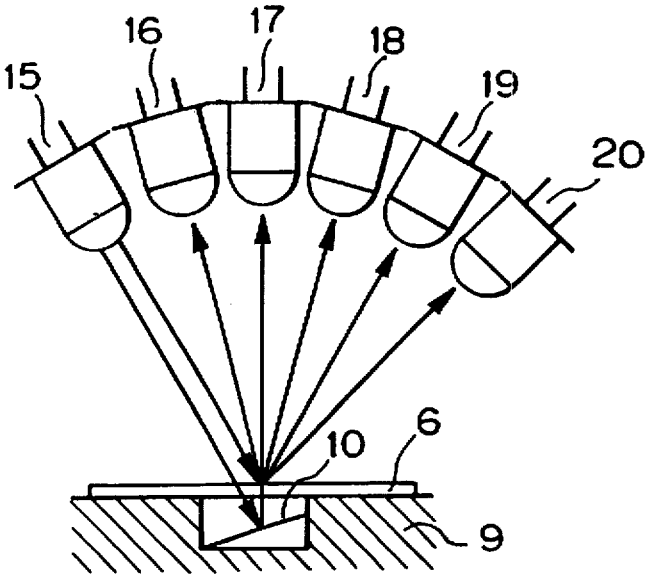
FIG. 5 is a schematic view which explains the structure of the recording medium discriminating apparatus of the present invention.

FIG. 5 is a diametrical view which schematically explains the structure of the reflection type photosensor 14. The reflection type photosensor 14 is composed of a light emitting element 5 and a plurality of light receiving elements 16 to 20.

Each of the light emitting element 15 and the light receiving elements 16 to 20 includes a light collecting optical system which is disposed on an arc with one point disposed on the recording medium 6 as a center for the arc, and focus is situated on the foregoing point.

In general, a reflection coefficient on the surface of a substance is represented by a function which depends on a light source, an angle of visual line and a normal line on the surface of the substance. This is called a multi-directional reflection coefficient function, and since the multi-directional reflection coefficient function closely correlates to the physical properties of the surface of the substance, it has a function form which differs from recording medium to recording medium. Therefore, by measuring the multi-directional reflection coefficient function of the recording medium, the kind of the recording medium can be identified.

Figure 6A:
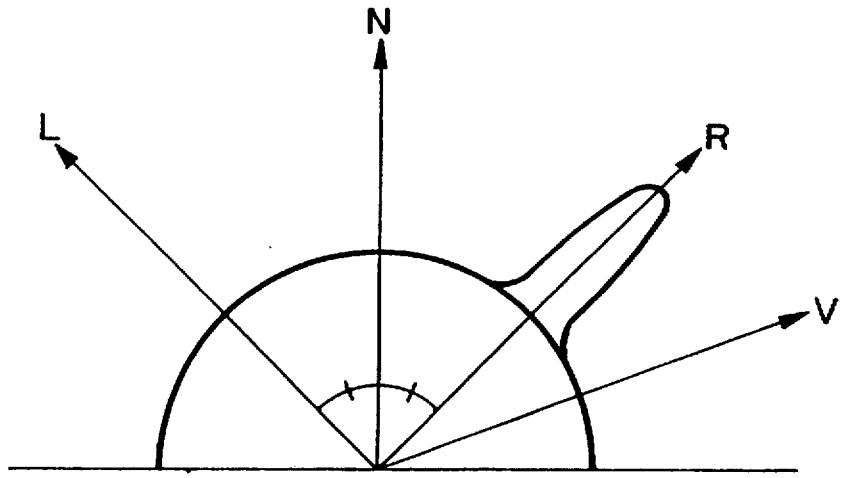
FIG. 6A is a view which shows by way of example a multi-directional reflection function to which the recording medium discriminating device of the present invention is applied, and moreover, shows a reflection distributing curve of a bright paper.
Figure 6B:
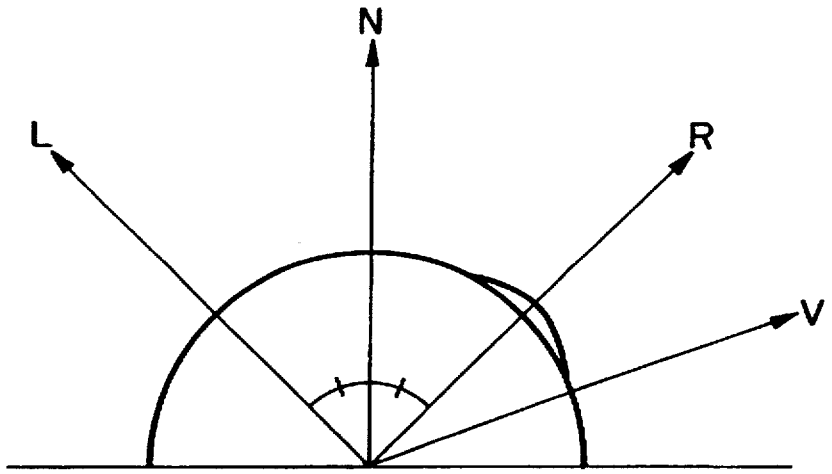
FIG. 6B is a view which shows by way of example a multi-directional rejection function to which the recording medium discriminating device of the present invention is applied, and moreover, shows a reflection distributing curve of less bright paper.

FIG. 6A and FIG. 6B are schematic views which show by way of example the multi-directional reflection coefficient function. FIG. 6A is a reflection distributing curve of a bright recording paper, and FIG. 6B is a reflection distribution curve of less bright recording paper. In the drawing, reference character L denotes a light source vector, reference character V denotes a visual line vector, reference character N denoted a normal line vector of the reflection surface, and reference character R denotes a normal reflection vector. As is apparent from the drawings, the less bright recording paper exhibits low reflection coefficient angle dependency, while the bright recording paper shows the function shape having a peak as viewed in the normal reflection direction.

Here, multi-directional reflection coefficient functions are preliminarily measured and stored with respect to the front surface and the rear surface of each recording medium, and it is assumed that when the sum of a square of a difference between the first-mentioned multi-directional reflection coefficient function and a multi-directional reflection coefficient function measured by the light receiving elements 16 to 20 is minimized, the recording medium is taken as a discrimination result.

Incidentally, a light receiving array to which the light beam is conducted via an optical fiber may be substituted for the light receiving elements each including an optical system. It is sufficient that two or more light receiving optical elements are provided for the purpose of discrimination. Also, it is acceptable that instead of a plurality of light receiving elements used for the purpose of discrimination, a single light receiving element is used, and a mechanism for rotating the light receiving element while the latter is always oriented toward a center located within a circumference on the recording medium is employed.

Since in this embodiment, the multi-directional reflection coefficient functions are directly compared with each other, a memorizing capacity necessary for the storage is increased when it is intended to elevate the result of discrimination by increasing the number of measuring points.

The multi-directional reflection coefficient function is heretofore modelled, and it is known for any expert in the art that each reflection light includes two components, i.e., a dispersion reflection light and a specular reflection light. The dispersion reflection light is such that it is irradiated into a substance, reflection is repeated within the substance, and thereafter, it is discharged from the substance. For this reason, a characterizing feature of the dispersion reflection light does not have directionality. On the other hand, the specular reflection light is such that its highlight component appears on the bright surface, and it has a spread corresponding to coarseness of the surface with a normal reflection angle as a center.

The following equation (1) shows by way of example that the multi-reflection function is modelled by using three parameters, i.e., a dispersion reflection coefficient ($R_d$), a specular reflection coefficient ($R_s$) and a specular light's spread (m). Thus, the multi-directional reflection function is such that a function that is called a Cook trans model is simplified.

$$R = R_d + \frac{R_s D(m,\alpha)}{\cos\theta_{in}\cos\theta_{out}} \tag{1}$$

where $$D(m,\alpha) = \frac{1}{m^2\cos^4\alpha}\exp\left(-\frac{\tan^2\alpha}{m^2}\right) \tag{2}$$

where θin is an angle defined by the vector of an incident angle: θout is an angle defined by the visual line's vector and the vector normal to the surface; and α represents an angle defined by the vector equally dividing the incident angle and the outgoing angle. In addition, D is called a Beckmann function.

When the above two equations (1) and (2) are used, an intensity θin of the incident light and an intensity θout of the outgoing light are associated with each other by the following equation (3).

$$I_{out} = I_{in}R\cos\theta_{in} = R_d\cos\theta_{in}I_{in} + \frac{R_sD(m,\alpha)}{\cos\theta_{out}} I_{in} \quad (3)$$

It is known for any expert in the art that the function derived from these parameters provides a good approximation to the practical multi-directional reflection function. Therefore, the kind of a recording medium can exactly be identified by comparing dimensions of these parameters calculated by applying the measuring results of the multi-directional reflection coefficient function of the recording medium to the above-noted model.

Since calculation of the parameters from the multi-reflection coefficient function is conducted by employing an optimizing calculation method such as a method of least square and so forth, the calculation cost is expensive but reliability on measuring results can be elevated without any increasing of the necessary memorizing capacity although the number of measuring points increases. Consequently, it becomes possible to conduct exact discrimination. One example associated with this will be shown in a second embodiment.

<Second Embodiment>

Figure 7:
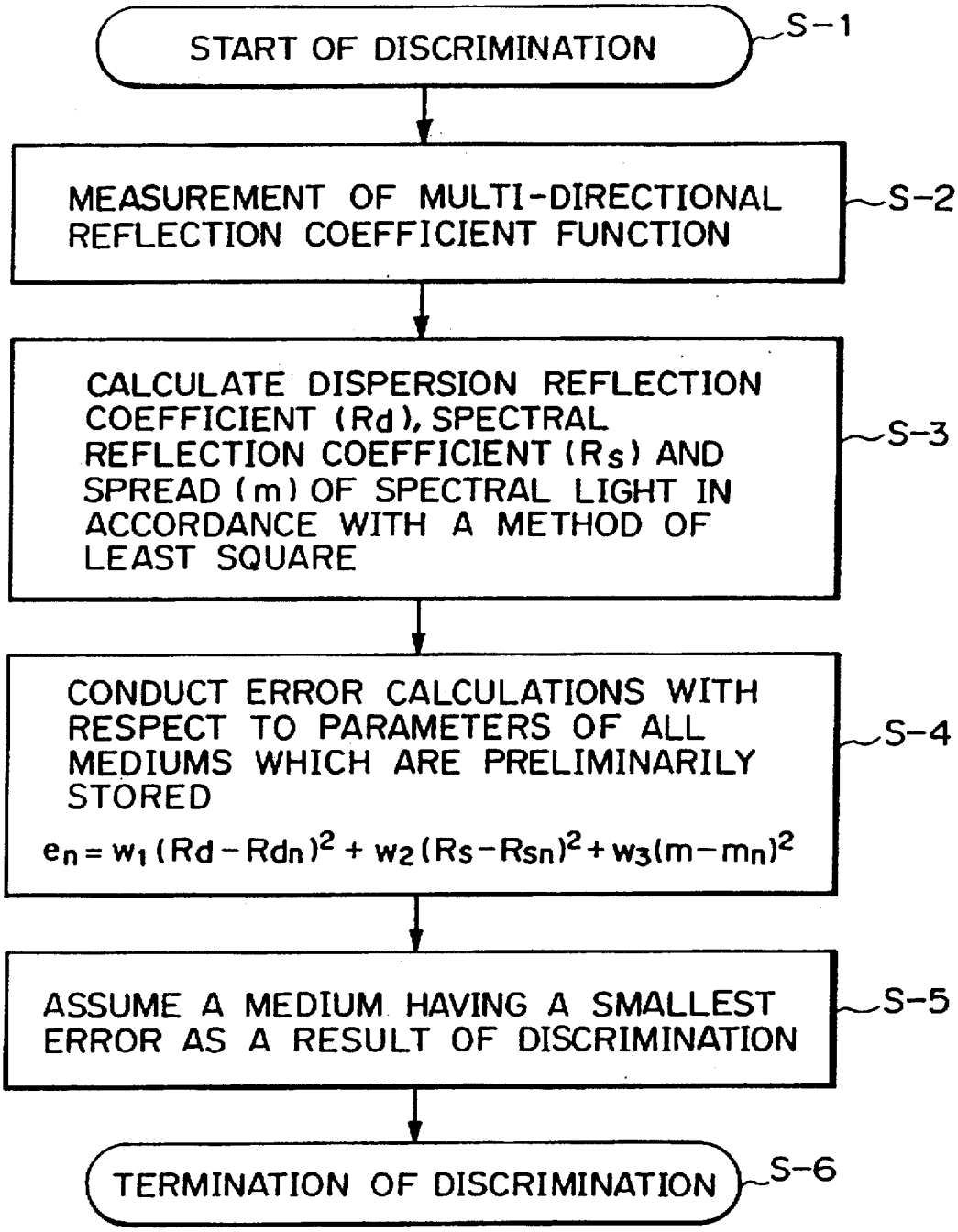
FIG. 7 is a flowchart which explains a series of measuring of the multi-directional reflection coefficient function to be performed by the recording medium discriminating device of the present invention.

FIG. 7 is a flowchart which explains an second embodiment of the recording medium discriminating device.

First, a reflective type photosensor scans the surface of a recording medium while displacing together with a carriage in the main scanning direction so that a reflection coefficient on the foregoing surface is measured. After completion of the measurement, discrimination of the recording medium is started based on the information on the inputted reflection coefficient (S-2).

Reflection coefficient of the recording medium is obtained in the form of a multi-directional reflection coefficient which depends on a light source, a visual line angle, and a normal line to the surface of the recording medium (S-2).

Next, the parameters derived from the multi-directional refection coefficient function are calculated by employing a method of least square (S-2).

Now, it is assumed that an angle θin of an incident light and an intensity Iin of the incident angle are fixed and an intensity $I_{out}$ of an outgoing light is measured by changing a visual angle $\theta_{out}$ by the number n of types. Thus, calculation of parameters from the multi-directional reflection coefficient function is intended to discover $R_d$, $R_s$ and m so as to allow the following equation (4) to be minimized. In other words, the foregoing calculation leads to a problem of discovering a minimum value of the function.

$$e(R_d, R_s, m) = \sum_{k=1}^{n} (I_{outk} - I_{outk})^2 \quad (4)$$

where $$I_{outk} = R_d \cos\theta_{in}I_{in} + \frac{R_sD(m, \alpha)}{\cos\theta_{outk}} I_{in} \quad (5)$$

various methods such as a Jacobi method, a steepest descent method or the like are available with respect to a procedure of calculating a minimum value. Since these methods are well known for the expert in the art, repeated description on them is herein omitted.

Results derived from the above calculation are compared with preliminarily measured reference parameter values of the recording medium, and subsequently, error calculation is conducted (S-4).

Finally, the medium having a most smallest error is taken as a result of discrimination (S-5).

Thus, it is possible to more accurately discriminate the medium from the measured multi-directional reflection coefficient function without increasing the memorizing capacity.

In the first embodiment and the second embodiment, the multi-directional reflection coefficient is measured with single spectral sensitivity properties but a characterizing feature on spectral reflection coefficient of the recording medium is not taken into account. For example, with respect to a recording medium coated with some kind of coating material, it is difficult to discriminate a difference of substrate merely by a difference of surface reflection coefficient in the presence of a visual light beam but it becomes comparatively easily possible to discriminate the recording medium by additionally using the surface reflection coefficient within the range outside the near-infrared rays. One example of this discrimination will be described below as a third embodiment.

<Third Embodiment>

Figure 8:
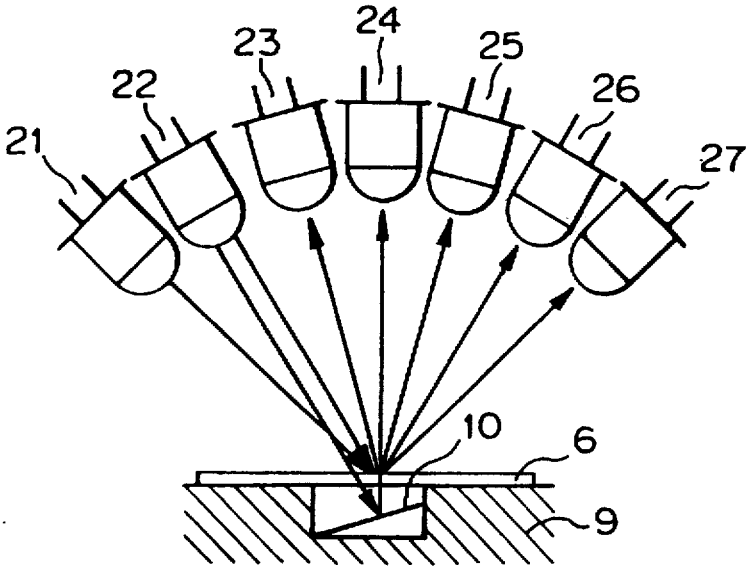
FIG. 8 is a schematic view which explains operations of a recording medium discriminating device constructed in accordance with another embodiment of the present invention.

FIG. 8 is a diagrammatical view which explains a third embodiment of the recording medium discriminating device to which the present invention is applied.

In the drawing, reference numeral 21 denotes a light emitting element of near-infrared rays, reference numeral 22 denotes a light emitting element of visual light, and reference numerals 23 to 27 denote light receiving elements each sensitive to visual light and near-infrared rays, respectively.

By lighting the light emitting element 21, the multi-directional reflection coefficient function can be measured with respect to the near-infrared rays. By lighting the light emitting element 22, the multidirectional reflection coefficient function can be measured with respect to the visual light.

By doing this, it is possible to more exactly discriminate the kind of the recording medium and the front surface or the rear surface of the recording medium also by using information on the wavelength.

As described above, according to the present invention, the kind of recording medium can more exactly be judged by measuring the reflection coefficient of the surface of the recording medium from a plurality of angles depending on one or more spectral sensitivity properties. Therefore, it becomes possible to record a high quality of image corresponding to the kind of recording medium. In addition, by exactly discriminating the front surface or the rear surface of the recording medium, erroneous recording on the front surface or the rear surface of the recording medium can be prevented by exactly discriminating the front or the rear surface of the recording medium. Thus, maneuverability of the recording medium discriminating apparatus can be improved.

<Other Embodiments>

Since the ink jet recording apparatus constructed in accordance with the first to third embodiments makes it possible to perform a recording operation not only at a high density but also at a high speed, it is possible to utilize it as outputting means for an information processing system, e.g., a printer for a copying machine, a facsimile, an electronic typewriter, a word processor, a work station, a work station and so forth to serve as a terminal unit or a handy or portable printer to be equipped with a personal computer, a host computer, an optical disc unit, a video unit and so forth. In this case, it of course is possible that the ink jet printing apparatus is constructed corresponding to a function specific to the apparatus and a manner of use and so forth.

Further, the ink jet recording apparatus constructed in accordance with the first to third embodiments can be used as a colored ink jet recording apparatus. In this case, a color image is formed by overlapping ink droplets ejected from a plurality of recording heads one above another or arranging them in the form of a matrix (N×N). Generally, in the case that color recording is performed, four kinds of recording heads and ink cartridges corresponding to plural colors, i.e., three primary colors consisting of yellow (Y), magenta (M) and cyan (C) or the three primary colors plus black (B) are required. Therefore, it is possible that the ink jet recording apparatus is constructed to mount three or four kinds of recording heads corresponding to three to four color so as to form an image with full color.

Further, the ink jet recording apparatus can comparatively easily be constructed to record a large size of recording paper such as A1-size or the like. Specifically, an A1-sized color ink jet recording apparatus adapted to copy an original, e.g., a plotter such as CAD outputting printer is put in practical use by coupling a reader for reading an image. To cope with recording on a sheet of OH film projectable for presentation in a conference, a lecture or the like, the ink jet recording apparatus makes it possible to select a recording medium having different ink absorbing properties as desired.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

$$R = R_d + \frac{R_s D(m,\alpha)}{\cos\theta_{in}\cos\theta_{out}} \tag{1}$$

$$D(m,\alpha) = \frac{1}{m^2\cos^4\alpha}\exp\left(-\frac{\tan^2\alpha}{m^2}\right) \tag{2}$$

$$I_{out} = I_{in}R\cos\theta_{in} = R_d\cos\theta_{in}I_{in} + \frac{R_s D(m,\alpha)}{\cos\theta_{out}} I_{in} \tag{3}$$

$$e(R_d, R_s, m) = \sum_{k=1}^{n} (I_{outk} - \hat{I}_{outk})^2 \tag{4}$$

$$\hat{I}_{outk} = R_d\cos\theta_{in}I_{in} + \frac{R_s D(m,\alpha)}{\cos\theta_{outk}} I_{in} \tag{5}$$

What is claimed is:

1. A recording medium discriminating device, comprising:

measuring means for detecting reflected light from one point on a surface of a recording medium at three or more different detecting positions and measuring a multi-directional reflection coefficient function on the surface of a recording medium based on the results of the detection; and judging means for judging the kind of recording medium based on the results of measuring said multi-directional reflection coefficient function.

2. A recording medium discriminating device as claimed in claim 1, wherein the recording medium is a recording medium which is usable for recording image informations with the aid of an ink jet recording apparatus.

3. A recording medium discriminating device as claimed in claim 1, wherein said measuring means includes at least one light emitting member and at least one photoelectric transducer member.

4. A recording medium discriminating device as claimed in claim 3, wherein at least one of said light emitting members and said photoelectric transducer member includes a light collecting optical system of which focus is situated on the recording medium.

5. A recording medium discriminating device as claimed in claim 4 further including means for allowing at least one vector among a light source vector between said light emitting member and the focus and a visual line vector between said photoelectric transducer and the focus to be changed.

6. A recording medium discriminating device as claimed in claim 3, wherein each of said light emitting member and said photoelectric transducer member is constructed of a semiconductor element.

7. A recording medium discriminating device, comprising:

measuring means for detecting reflected light from one point on a surface of a recording medium at three or more different detecting positions and measuring a multi-reflection coefficient function on the surface of a recording medium based on a plurality of spectral sensitivity properties; and judging means for judging the kind of recording medium based on the results of measuring said multi-directional reflection coefficient function.

8. A recording medium discriminating device as claimed in claim 7, wherein the recording medium is a recording medium usable for recording image informations with the aid of an ink jet recording apparatus.

9. A recording medium discriminating device as claimed in claim 7, wherein said measuring means includes at least one light emitting means and at least one photoelectric transducer.

10. A recording medium discriminating device as claimed in claim 9, wherein at least one of said light emitting means and said photoelectric transducer includes a light collecting optical system of which focus is located on the surface of the recording medium.

11. A recording medium discriminating device as claimed in claim 10, further including means for allowing at least one vector among a light source vector between said light emitting means and the focus and a visual line vector between said photoelectric transducer and the focus to be changed.

12. A recording medium discriminating device as claimed in claim 9, wherein each of said light emitting means and said photoelectric transducer is constructed of a semiconductor element.

13. An ink jet recording apparatus, comprising:

a carriage having recording means adapted to output image information by ejecting ink droplets to a recording medium mounted thereon, said carriage serving to displace said recording means in the main scanning direction; and conveying means for conveying said the recording medium in the auxiliary scanning direction, wherein said ink jet recording apparatus includes a recording medium discriminating device having measuring means for detecting reflected light from one point on a surface of the recording medium at three or more different detecting positions and measuring a multi-directional reflection coefficient function on the surface of the recording medium, and judging means for judging the kind of recording medium based on the results of measuring said multi-directional reflection coefficient function.

14. An ink jet recording apparatus as claimed in claim 13, wherein said measuring means includes at least one light emitting member and at least one photoelectric transducer, and at least one of said light emitting member and said photoelectric transducer includes a light collecting optical system of which focus is situated on the recording medium.

15. An ink jet recording apparatus as claimed in claim 14, further including means for allowing at least one vector among a light source vector between said light emitting member and the focus and a visual line vector between said photoelectric transducer and the focus to be changed.

16. An ink jet recording apparatus as claimed in claim 14, wherein each of said light emitting member and said photoelectric transducer is constructed of a semiconductor element.

17. An ink jet recording apparatus as claimed in claim 13, further including means for controlling a recording operation to be performed based on data outputted from said recording medium discriminating device and for controlling conveyance of said recording medium with the aid of said conveying means.

18. An ink jet recording apparatus as claimed in claim 13, wherein the recording medium discriminating device is displaced in the main scanning direction as said recording means is displaced.

19. An ink jet recording apparatus as claimed in claim 13, said recording means including a thermoelectric transducer for generating energy for ejecting ink droplets therefrom.

20. An ink jet recording apparatus including a carriage adapted to output image information by ejecting ink droplets to a recording medium mounted thereon, said carriage serving to displace the recording medium in the main scanning direction and convey the recording medium in the auxiliary direction, said ink jet recording apparatus including a recording medium discriminating device having measuring means for detecting reflecting light from one point on a surface of the recording medium at three or more different detecting positions and measuring a multi-directional reflection coefficient function on the surface of the recording medium based on the detected results and a plurality of spectral sensitivity properties, and judging means for judging the kind of recording medium based on the results of measuring said multi-directional reflection coefficient function.

21. An ink jet recording apparatus as claimed in claim 20, wherein in said measuring means includes at least one light emitting member and at least one photoelectric transducer, and at least one of said light emitting member and said photoelectric transducer includes a light collecting optical system of which focus is situated on the recording medium.

22. An ink jet recording apparatus as claimed in claim 21, further including means for allowing at least one vector among an optical source vector between said light emitting member and the focus and a visual vector between said photoelectric transducer and the focus to be changed.

23. An ink jet recording apparatus as claimed in claim 21, wherein each of said light emitting means and said photoelectric transducer is constructed of a semiconductor element.

24. An ink jet recording apparatus as claimed in claim 20, further including means for controlling a recording operation with reference to data to be outputted from said recording medium discriminating device, and means for controlling conveyance of the recording medium by said carriage.

25. An ink jet recording apparatus as claimed in claim 20, wherein said recording medium discriminating device is displaced in the main scanning direction as the recording medium is displaced.

26. An ink jet recording apparatus as claimed in claim 20, wherein said carriage includes recording means having a thermoelectric transducer for generating energy to elect ink droplets.

27. An information processing system, comprising:

a recording device having an ink jet recording apparatus with recording means for outputting image information by ejecting ink droplets toward a recording medium mounted thereon, and including a carriage for displacing said recording means in the main scanning direction and conveying means for conveying the recording medium in the transverse direction;

a recording medium discriminating device including measuring means for detecting reflected light from one point on a surface of a recording medium at three or more different detecting positions and measuring a multi-directional reflection coefficient function on the surface of the recording medium based on the detected results and a plurality of spectral sensitivity properties, and judging means for judging the kind of recording medium based on the results of measuring said multi-directional reflection coefficient function.

28. A recording medium discriminating method, comprising the steps of:

detecting reflected light from one point on a surface of a recording medium at three or more different detecting positions;

measuring a multi-directional reflection coefficient function on the surface of the recording medium based on the detected results; and judging the kind of recording medium based on the results of measuring the multi-directional reflection coefficient function.

29. A recording medium discriminating method as claimed in claim 28, wherein the recording medium is a recording medium usable for recording image informations outputted from an ink jet recording apparatus.

30. A recording medium discriminating method as claimed in claim 28, wherein said measuring step includes the use of at least one light emitting member and at least one photoelectric transducer.

31. A recording medium discriminating method as claimed in claim 30, wherein at least one of the light emitting member and the photoelectric transducer includes at least one light collecting optical system of which focus is situated on the recording medium.

32. A recording discriminating method as claimed in claim 31, further comprising the step of allowing at least one vector among a light source vector between the light emitting member and the focus and a visual line vector between the photoelectric transducer and the focus to be changed.

33. A recording medium discriminating method, comprising the steps of:

detecting reflected light from one point on a surface of a recording medium at three or more different detecting positions;

measuring a multi-directional reflection coefficient function on the surface of the recording medium with reference to a plurality of spectral sensitivity properties; and judging the kind of recording medium based on the results of measuring the multi-directional reflection coefficient function.

34. A recording medium discriminating method as claimed in claim 33, wherein the recording medium is a recording medium usable for recording image informations outputted from an ink jet recording apparatus.

35. A recording medium discriminating method as claimed in claim 33, wherein said measuring step includes the use of at least one light emitting member and at least one photoelectric transducer.

36. A recording medium discriminating method as claimed in claim 35, wherein at least one of the light emitting member and the photoelectric transducer includes at least a light collecting system of which focus is located on the recording medium.

37. A recording medium discriminating method as claimed in claim 36, further including the step of allowing at least one vector among a light source vector between the light emitting member and the focus and a visual line vector between the photoelectric transducer and the focus to be changed.

* * * * *

UNITED STATES PATENT AND TRADEMARK OFFICE

CERTIFICATE OF CORRECTION

PATENT NO. : 5,764,251

DATED : June 9, 1998

INVENTOR(S) : REIJI HASHIMOTO

It is certified that error appears in the above-identified patent and that said Letters Patent is hereby corrected as shown below:

Column 1:

Line 25, "means" should read --means,--.

Column 2:

Line 27, "medium" should read --medium.--.

Column 3:

Line 11, "manerverability" should read --maneuverability--;
Line 17, "comprising;" should read --comprising:--;
Line 38, "each" should read --Each--;
Line 43, "prising" should read --prising:--.

Column 5:

Line 48, "prising" should read --prising:--.

UNITED STATES PATENT AND TRADEMARK OFFICE

CERTIFICATE OF CORRECTION

PATENT NO. : 5,764,251

DATED : June 9, 1998

INVENTOR(S) : REIJI HASHIMOTO

It is certified that error appears in the above-indentified patent and that said Letters Patent is hereby corrected as shown below:

Column 6:

Line 6, "prising;" should read --prising:--; and
Line 55, "rejection" should read --reflection--.

Column 8:

Line 3, "denoted" should read --denotes--.

Column 9:

Line 24, "an second" should read --a second--;
Line 50, "Ioutk)$^2$" should read --Îoutk)$^2$--;
Line 55, "Ioutk=" should read --Îoutk=--;
Line 57, "various" should read --Various--; and
Line 66, "a most" should read --the--.

Column 10:

Line 58, "a work station, a work station" should read --a work station--.

UNITED STATES PATENT AND TRADEMARK OFFICE

CERTIFICATE OF CORRECTION

PATENT NO. : 5,764,251

DATED : June 9, 1998

INVENTOR(S) : REIJI HASHIMOTO

It is certified that error appears in the above-identified patent and that said Letters Patent is hereby corrected as shown below:

Column 11:

After line 27 (before the equation), insert --Table of Equations-- (centered).

Line 63, "transducer member" should read --transducer members--; and

Line 67, "claim 4" should read --claim 4,--.

Column 12:

Line 48, "said the" should read --the--.

Column 13:

Line 39, "in said measuring" should read --said measuring--;

Line 50, "emitting means" should read --emitting member--; and

Line 64, "elect" should read --eject--.

UNITED STATES PATENT AND TRADEMARK OFFICE

CERTIFICATE OF CORRECTION

PATENT NO. : 5,764,251

DATED : June 9, 1998

INVENTOR(S) : REIJI HASHIMOTO

It is certified that error appears in the above-identified patent and that said Letters Patent is hereby corrected as shown below:

Column 14:

Line 5, "transverse direction;" should read --transverse direction; and--.

Signed and Sealed this

Sixteenth Day of March, 1999

*Attest:*

*Attesting Officer*

Q. TODD DICKINSON

*Acting Commissioner of Patents and Trademarks*